US005177887A

United States Patent [19]

McGugan et al.

[11] Patent Number: 5,177,887

[45] Date of Patent: Jan. 12, 1993

[54] SNOW WING

[75] Inventors: Edward McGugan, Holyrood; Leonard Harman, Goderich, both of Canada

[73] Assignee: Champion Road Machinery Limited, Goderich, Canada

[21] Appl. No.: 750,923

[22] Filed: Aug. 28, 1991

[51] Int. Cl.[5] ..... E01H 5/04

[52] U.S. Cl. ..... 37/236; 37/234; 37/279; 37/266

[58] Field of Search ..... 37/232, 234, 236, 235, 37/266, 270, 271, 279

[56] References Cited

U.S. PATENT DOCUMENTS

| | | | |
|---|---|---|---|
| 2,144,698 | 1/1939 | Allan | 37/236 |
| 2,193,532 | 3/1940 | Frink | 37/234 |
| 2,643,470 | 6/1953 | Kaeser | 37/234 X |
| 2,991,566 | 7/1961 | Sumner et al. | 37/236 X |
| 3,125,818 | 3/1964 | Kraft et al. | 37/236 |
| 3,659,363 | 5/1972 | Snyder | 37/236 X |
| 4,045,892 | 9/1977 | Farrell | 37/279 X |
| 4,096,652 | 6/1978 | Raines et al. | 37/236 X |
| 4,320,589 | 3/1982 | Pelazza | 37/236 X |
| 4,969,280 | 11/1990 | Thorneloe | 37/236 X |

*Primary Examiner*—Randolph A. Reese
*Assistant Examiner*—J. Russell McBee

[57] ABSTRACT

A support arrangement for a blade of a construction machine is disclosed where the blade is located to one side of the construction machine. The support arrangement includes two support towers spaced in the length of the frame of the machine with these support towers accommodating variation in the elevation of the blade. The blade is pivotally secured at a forward end thereof to one of the support structures and secured adjacent the other end of the blade to the other support structure by means of two hydraulic cylinders which extend outwardly from the support structure. These hydraulic cylinders also include an arrangement for controlling the angle of the two hydraulic cylinders relative to the connected support structure. The arrangement for controlling the angle of the two hydraulic cylinders accommodates limited, rapid upward movement of the blade. This arrangement allows convenient adjustment of the blade to any desired operating position to one side of the construction machine while also providing an inherently strong support arrangement. This arrangement has particular application for snow wings normally secured to a motor grader or truck.

4 Claims, 4 Drawing Sheets

SNOW WING

FIELD OF THE INVENTION

The present invention relates to arrangements for supporting of a blade offset to one side of a construction machine or truck.

BACKGROUND OF THE INVENTION

Various arrangements have been proposed for supporting of a snow wing to one side of a construction machine, such as a motor grader or truck, with the most common arrangement having support towers attached to the motor grader. A number of cables connect the blade to the vehicle with the cables being adjustable in length for raising and lowering of the blade. Various cylinders or arms position the blade at one side of the vehicle. Other snow wing arrangements require the ground to provide support for the blade with hydraulic cylinders maintaining the blade at a certain position outwardly from the motor grader. Problems can occur with this type of structure when soft shoulders are encountered as the blade can dig into the soft shoulder and cause considerable damage. Operation of a motor grader equipped with a snow wing is relatively difficult and any snow wing system must be convenient to adjust. With the blade disposed to one side of the grader, large sudden forces exerted on the blade can cause the grader to be forced into the road and there is a requirement for the blade to be able to move quickly upwardly should an obstacle be encountered, such a rock frozen in a shoulder.

Examples of structures supporting snow wings are shown in U.S. Pat. Nos. 4,096,652, 4,045,892, 4,320,589, 2,643,470, 2,991,566, 2,144,698, 2,193,532, 3,125,818, 3,659,363 and Canadian Patents 1,131,907, 994,099, 1,164,652 and 1,212,540.

SUMMARY OF THE INVENTION

A support arrangement for a blade of a construction machine disposed to one side of the construction machine, according to the present invention, comprises two support structures secured to the frame of the construction machine which accommodate variation in the elevation of the blade. The blade is pivotally secured at a forward end thereof to one of the two support structures and secured adjacent the other end of the blade to the other support structure by means of two hydraulic cylinders. These hydraulic cylinders have means associated therewith for controlling the angle of the cylinders relative to the connected support structure. The means for controlling the angle of the two hydraulic cylinders accommodates limited, rapid upward movement of the blade without adjustment of the two hydraulic cylinders.

According to an aspect of the invention, the means for controlling the angle of the two hydraulic cylinders accommodates limited upward movement of the blade due to a pivoting link connected thereto and connected immediately adjacent the support structure. The pivoted link is biased by way of the blade to an operating position and is movable to an extended position allowing the blade to move upwardly a limited amount by overcoming the biasing force. This pivoted link provides a convenient mechanism which accommodates rapid upward movement of the blade should the blade encounter an obstacle, such as a rock, etc., when in use.

The link would be forced outwardly thereby allowing the blade to climb over the obstacle.

BRIEF DESCRIPTION OF THE DRAWINGS

Preferred embodiments of the invention are shown in the drawings, wherein.

DETAILED DESCRIPTION OF THE PREFERRED EMBODIMENTS

Figure 1:
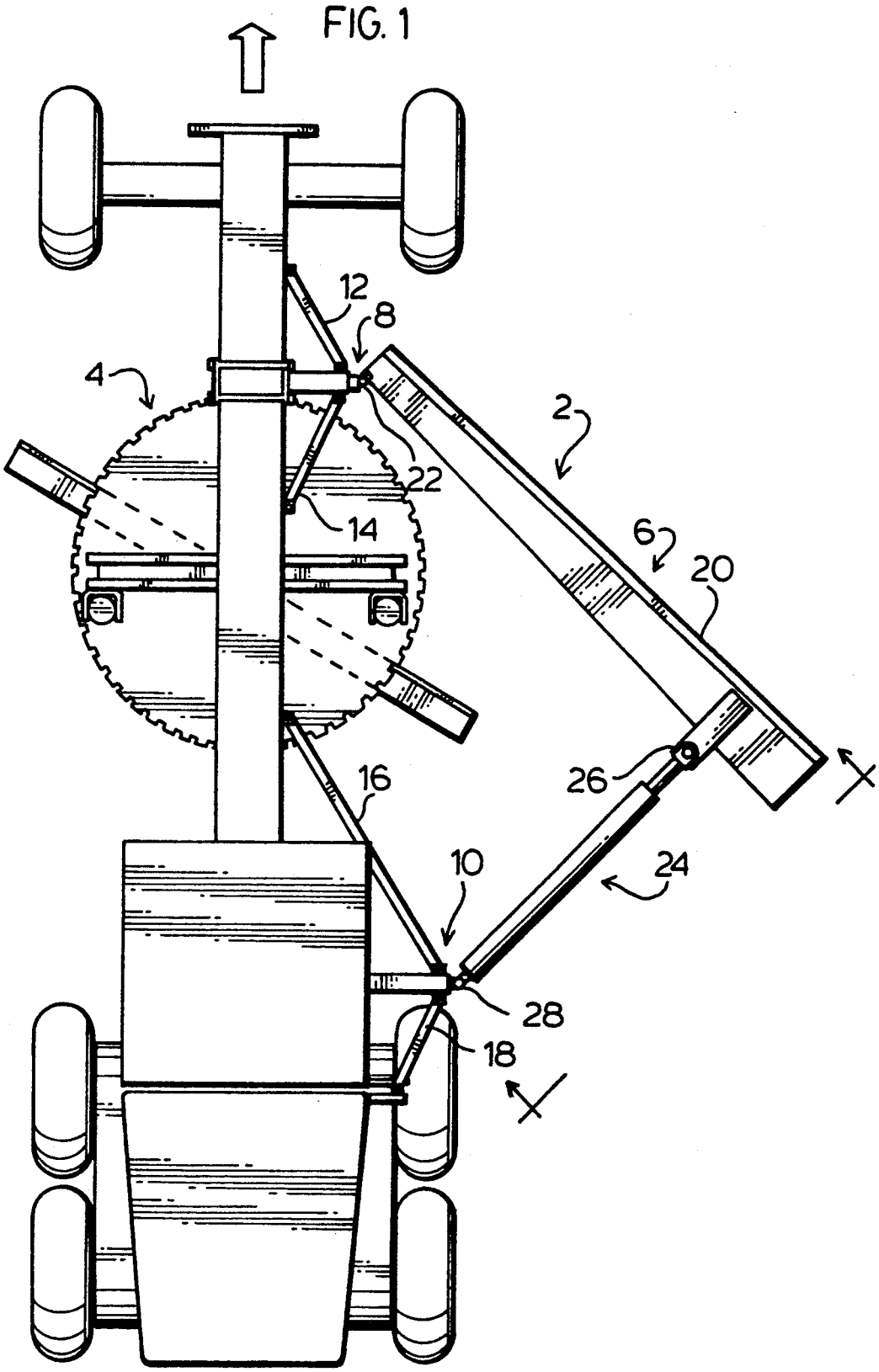
FIG. 1 is a top view of a motor grader having the snow wing disposed to one side of the grader.

The motor grader, or other suitable vehicle, generally shown as 2, has the grader blade 4 generally positioned centrally therebeneath and is shown with a snow wing 6 or blade disposed to one side of the motor grader 2. Support towers 8 and 10 are spaced in the length of the motor grader and support the snow wing 6. Bracing arrangements 12, 14, 16 and 18 maintain the towers in the desired position to one side of the motor grader. The snow blade 20 is thus positioned outwardly from the motor grader to the righthand side thereof. The snow blade 20 is secured to the support tower 8 by a pivoting support 22 which is also movable vertically within the support tower 8. Hydraulic arms 24 serve to maintain the snow wing at a desired angle and position outwardly from the motor grader 2.

Figure 2:
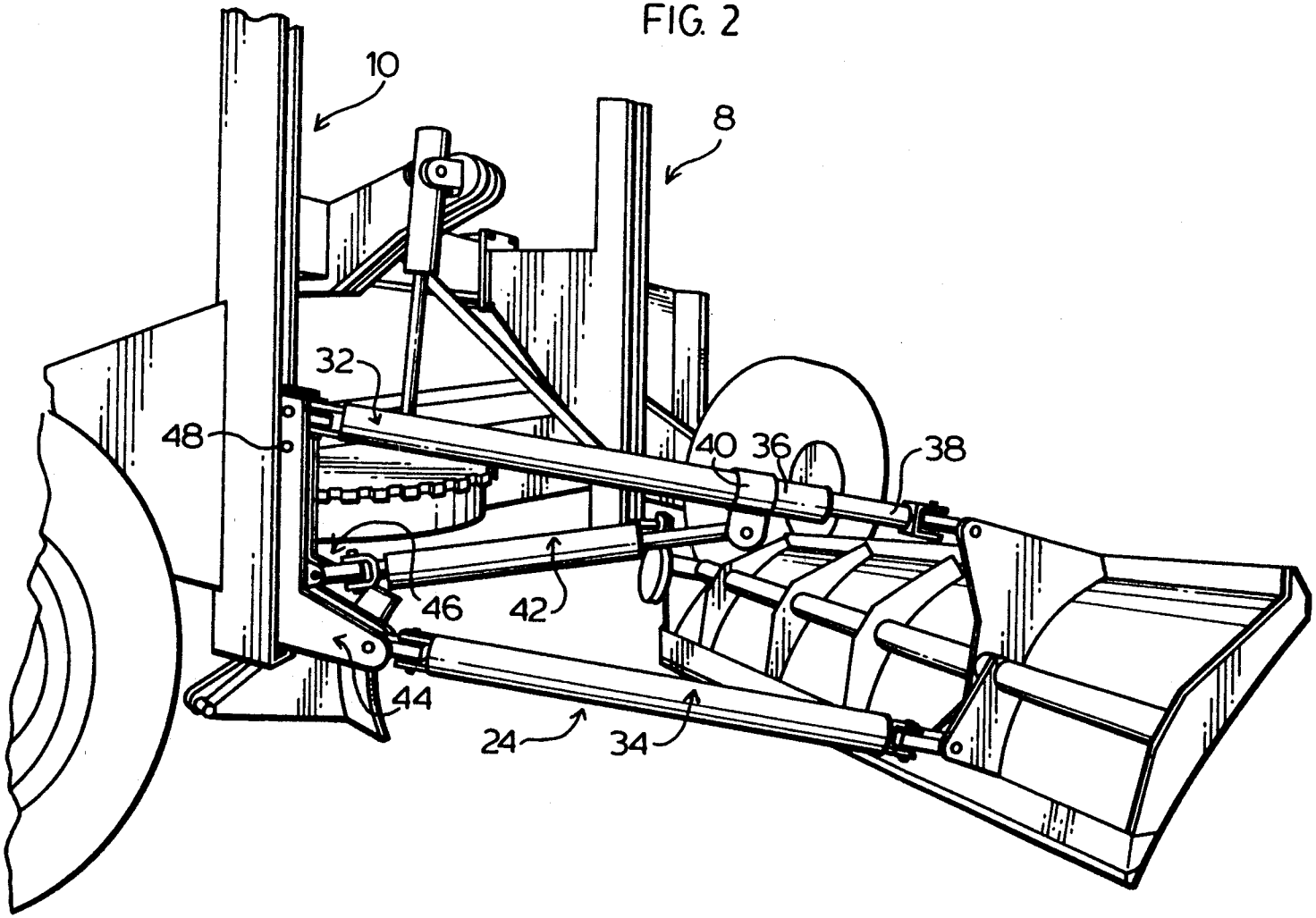
FIG. 2 is a perspective view showing support of the snow wing.

Details of the hydraulic arms 24 can be appreciated from FIGS. 2 through 5. As shown in FIG. 2, each of the hydraulic arms 24 are pivoted to the tower 10 and are directly or indirectly pivoted the snow blade 20 by a universal-type connection. The hydraulic arms 24 include the two hydraulic cylinders 32 and 34, with hydraulic cylinder 32 being an upper hydraulic cylinder and 34 being a lower hydraulic cylinder, which cooperate for controlling the end position of the snow blade. The upper hydraulic cylinder 32 includes a sleeve or barrel 36 and a movable rod or piston 38. Connected to the sleeve 36 is a clamp 40 which provides a lower securement point for the locating cylinder 42. The carriage 44 is movable within the support tower 10 and the hydraulic cylinders are connected to carriage 44. A pivoting link 46 is connected to the carriage at 48 and is shown in the operating position in FIG. 2. This link can move outwardly a limited extent to accommodate limited rapid upward movement of the blade.

Movement of the carriage 44 within the support tower 10 is accommodated easily. It is preferred that this carriage be controlled by the movement of a hydraulic cylinder located within the support tower 10. In any event, the carriage tower 44 may be generally fixed at any point within the support tower 10. With movement of the carriage 44, the pivot connections of the hydraulic arms 24 to the carriage also move upwardly.

Figure 3:
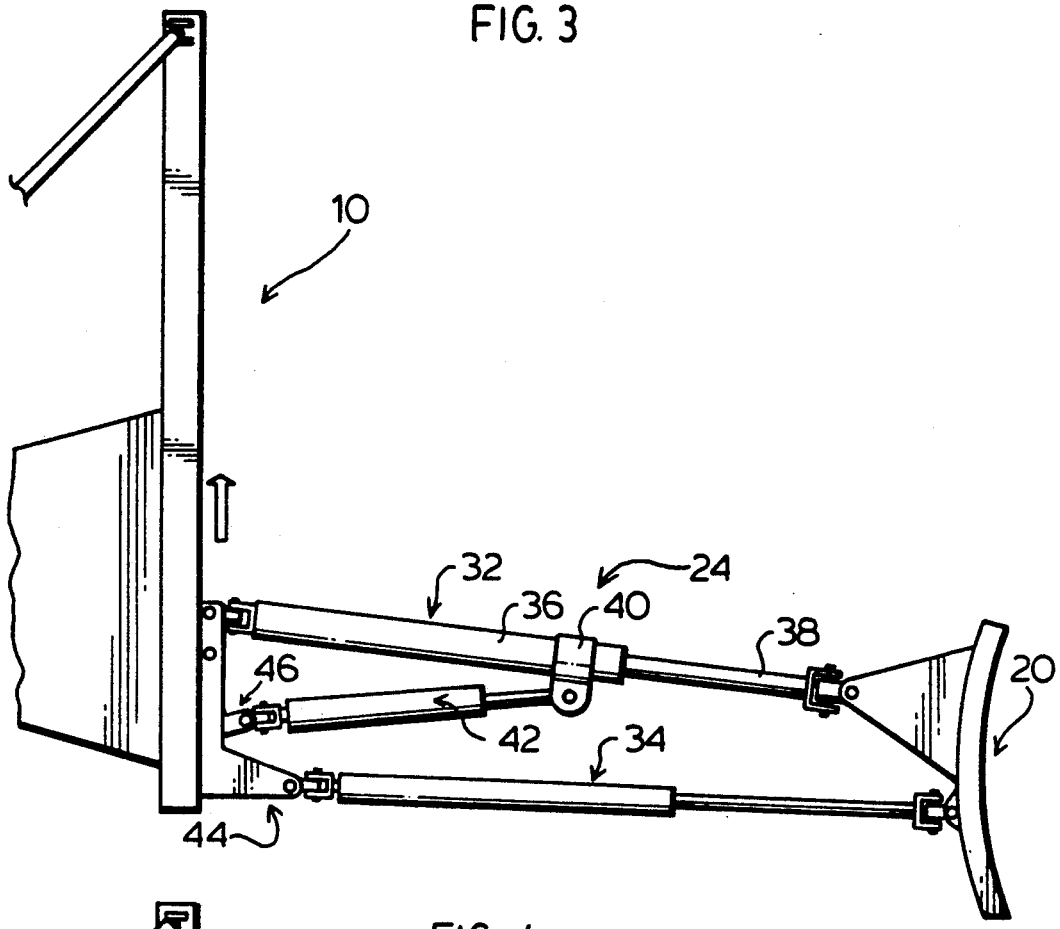
FIG. 3 is a side elevation showing support of the outer end of the snow wing.

FIG. 3 shows the various hydraulic cylinders used to control the end of the blade of the grader in a lower position in FIG. 3. It can be seen that the pitch of the blade can also be adjusted by increasing or decreasing the length of the hydraulic cylinders 32 and 34. In order to be capable of supporting the weight of the blade 20, the locating cylinder 42 is disposed at an angle relative to hydraulic cylinder 32. With this arrangement, lengthening of the locating cylinder 42 can cause an upward pivoting movement of the hydraulic cylinders 32 and 34. This will result in a raising of the blade of the grader. Thus, it can be appreciated that control of cylinders 32, 34 and 42 allows full adjustment of the position of the blade of the grader outwardly from the grader, the pitch of the blade as well as the angle of the hydraulic cylinders relative to the grader.

Figure 4:
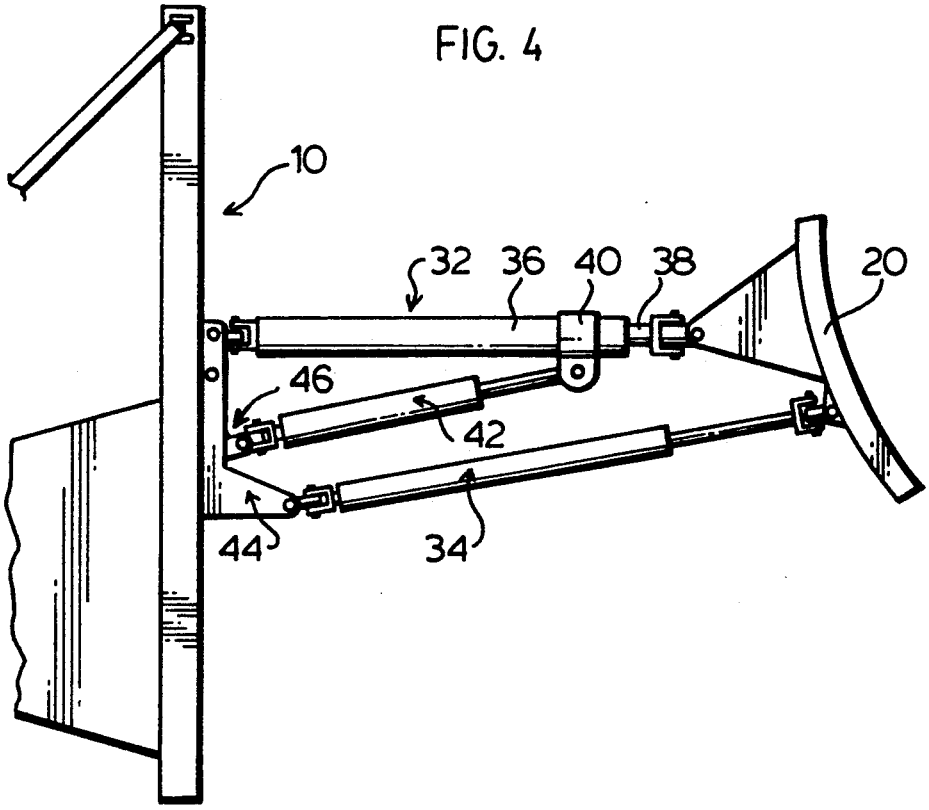
FIG. 4 is similar to FIG. 3, but showing the snow wing in a raised position.

FIG. 4 shows the snow wing in a raised position with the pitch of the blade being changed. The universal connections of the hydraulic cylinders to the blade and the carriage accommodate the various adjustments of the blade 20.

Figure 5:
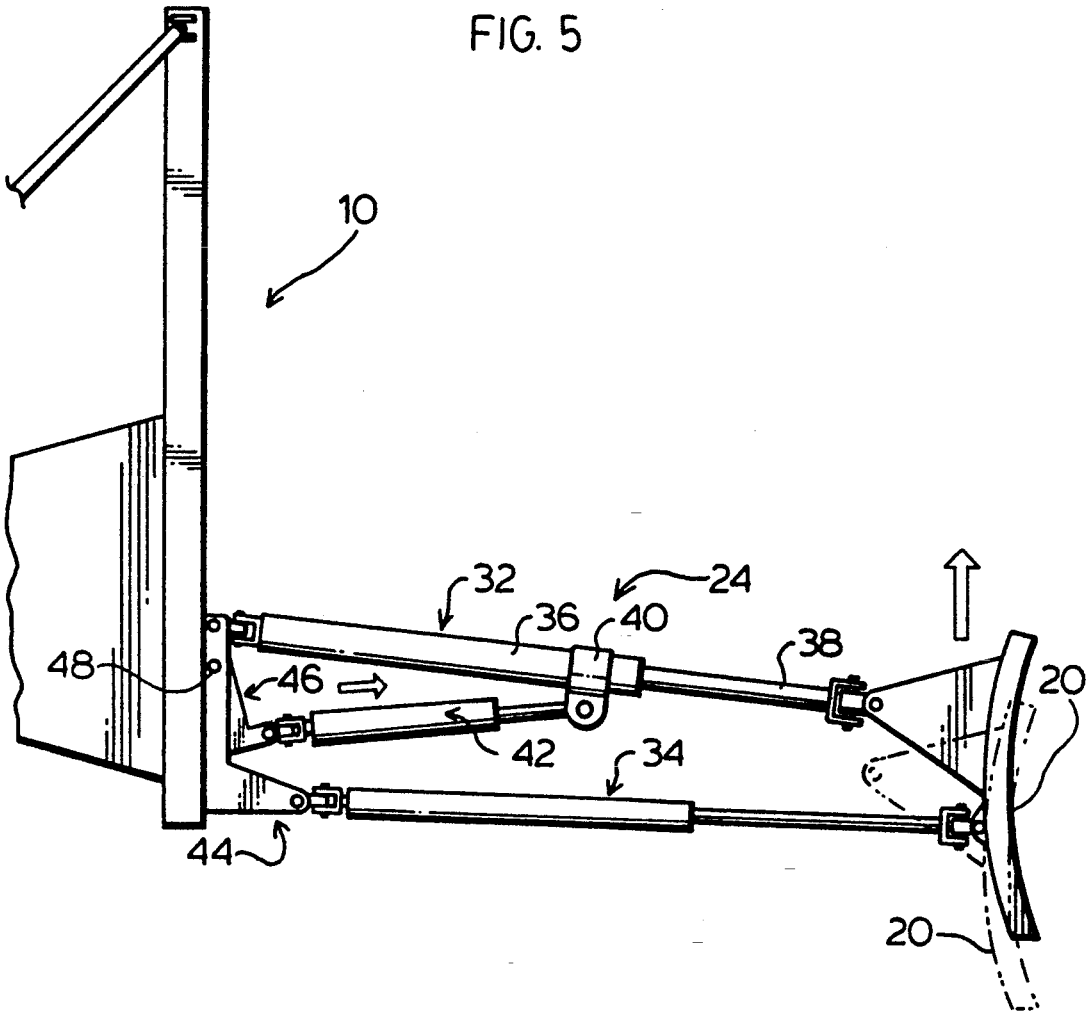
FIG. 5 is an end elevation showing operation of the pivoted link allowing the blade to move upwardly a limited amount.

Hydraulic cylinders 32, 34 and 42 thus cooperate to support and locate the snow blade 20 a certain distance and angle away from the frame of the grader 2 in a supported position. Hydraulic cylinders also have the ability to have relief valves associated therewith to act as safety devices should very high loads be unexpectedly encountered. With a snow blade located to one side of the grader, high loads can be encountered due to changing conditions such as loose snow changing to a frozen mass or a rock that is basically hidden beneath the snow being encountered by the edge of the blade 20. As can be appreciated, under winter conditions, the viscosity of the hydraulic fluid changes and the ability to quickly react and reduce the loads encountered by accommodating movement of a hydraulic fluid through relief valves is not sufficient to provide an effective response. This is overcome with the present system as shown in FIG. 5. The blade 20 is shown in dotted outline in its normal operating position and if a sudden obstacle is encountered requiring upward movement of the blade 20 to the position shown in solid lines in FIG. 5, this is accommodated due to movement of the pivoting link 46 within the carriage 44. As shown in solid lines, pivoting link 46 is moved outwardly and has now struck an end position limiting further outward movement. The snow wing 20 of the grader has been able to move upwardly quickly due to the rock creating necessary force to overcome the bias of the weight of the snow win related equipment and also causing an outward pivoting movement of the pivoting link 46. Once the blade has stepped over the article, the link 46 will move inwardly and return to the operating position shown in FIG. 3. Thus, the pivoting link provides a very fast reacting capability allowing the hydraulic cylinders to remain in their existing condition with respect to hydraulic fluid and relying on the pivoting connections to allow the upward movement of the blade shown in FIG. 5.

It is believed that this arrangement provides a simple solution which utilizes the advantages and convenience of hydraulic cylinders while also accommodating the rapid upward movement of the blade should unforeseen obstacles be encountered.

Although various preferred embodiments of the present invention have been described herein in detail, it will be appreciated by those skilled in the art, that variations may be made thereto without departing from the spirit of the invention or the scope of the appended claims.

The embodiments of the invention in which an exclusive property or privilege is claimed are defined as follows:

1. A support arrangement for a blade of a construction machine disposed to one side of the construction machine comprising first and second support structures secured to one side of the construction machine which accommodate variation in elevation of the blade, said blade being pivotally secured at a forward end thereof to said first support structure and secured adjacent the other end of said blade to said second support structure by means of two hydraulic cylinders, and means associated with said two hydraulic cylinders for controlling an angle of said cylinders relative to said second support structure, said means for controlling the angle of said two hydraulic cylinders mechanically accommodating limited rapid upward movement of the blade without adjustment of said two hydraulic cylinders, and wherein said means for controlling the angle of said two hydraulic cylinders is a hydraulic cylinder connected between said second support structure and a barrel portion of one of said two hydraulic cylinders, which barrel portion is adjacent said second support structure, whereby the angle of said two hydraulic cylinders relative to said second support structure is altered by length adjustment of said hydraulic cylinder connected to said barrel.

2. A support arrangement for a blade of a construction machine disposed to one side of the construction machine as claimed in claim 1 wherein said means for controlling the angle of said two hydraulic cylinders accommodates limited upward movement of said blade by means of a pivoting link connecting said means for controlling and said support structure to which said hydraulic cylinders are secured, said pivoting link being biased by a weight force of said blade to an operating position and is movable to an extended position allowing said blade to move upwardly a limited amount by overcoming the weight force.

3. A support arrangement for a blade of a construction machine disposed to one side of the construction machine as claimed in claim 2 wherein said means for controlling the angle of said two hydraulic cylinders and said two hydraulic cylinders are all supported by said second support structure and move with said second support structure as a unit.

4. A support arrangement for a blade of a construction machine disposed to one side of the construction machine as claimed in claim 1 wherein said blade is of a weight and said means for controlling the angle of said two hydraulic cylinders includes a pivoted link connected to a carriage member movably supported by said second support structure, said pivoted link being pivoted to said carriage at an upper end thereof and pivoted to said hydraulic cylinder of said means for controlling the angle of said two hydraulic cylinders at a lower end of said pivoted link, said pivoted link being biased by the weight of said blade to a position within said carriage and being movable to an extended position at an angle to said carriage to accommodate limited rapid upward movement of said blade without adjustment of said hydraulic cylinders.

* * * * *